United States Patent [19]

Clerk

[11] 4,364,131

[45] Dec. 21, 1982

[54] LIQUID RESERVOIR

[76] Inventor: Robert C. Clerk, 46, Cullen Dr., Glenrothes, Fife, Scotland, KY6 2JJ

[21] Appl. No.: 178,681

[22] Filed: Aug. 15, 1980

[30] Foreign Application Priority Data

Aug. 17, 1979 [GB] United Kingdom ..... 7928712

[51] Int. Cl.[3] ..... E04H 3/16; E04H 3/18

[52] U.S. Cl. ..... 4/495; 4/498; 4/499; 4/501

[58] Field of Search ..... 4/495, 501, 491, 494, 4/498, 499, 505, 504, 508

[56] References Cited

U.S. PATENT DOCUMENTS

| | | | |
|---|---|---|---|
| 1,403,009 | 1/1922 | Carter | 4/492 |
| 3,091,777 | 6/1963 | Pearlson | 4/495 |
| 3,242,503 | 3/1966 | Russo | 4/495 |
| 3,423,768 | 1/1969 | Glenn | 4/501 |
| 3,734,113 | 5/1973 | Madden | 4/495 |
| 3,760,432 | 9/1973 | Glorisi | 4/495 |
| 3,813,704 | 6/1974 | Troiano | 4/501 |
| 3,871,033 | 3/1975 | Bartlett | 4/499 |
| 3,915,450 | 10/1975 | Flewwelling et al. | 4/491 |
| 4,236,258 | 12/1980 | Batstone | 4/495 X |

FOREIGN PATENT DOCUMENTS 2031273 4/1980 United Kingdom .

*Primary Examiner*—Henry K. Artis

*Attorney, Agent, or Firm*—Dann, Dorfman, Herrell and Skillman

[57] ABSTRACT

A liquid reservoir, for example a swimming bath, a test tank or an aquaculture tank, comprises an open-topped container having at least one side wall, a first floor fixed relative to the side wall(s) and a second floor above the first floor which is able to move upwardly and downwardly relative to the side wall(s) in order to vary the height and/or inclination of the second floor in relation to the first floor. The reservoir comprises means for varying the specific gravity of the second floor between a value above and a value below the specific gravity of the liquid of the reservoir. Passageways between the side edge of the second floor and the side wall(s) of the container and/or through the second floor enable liquid to flow between the space between the two floors and another space above the second floor when the height of the second floor is varied.

15 Claims, 9 Drawing Figures

LIQUID RESERVOIR

Figure 1:
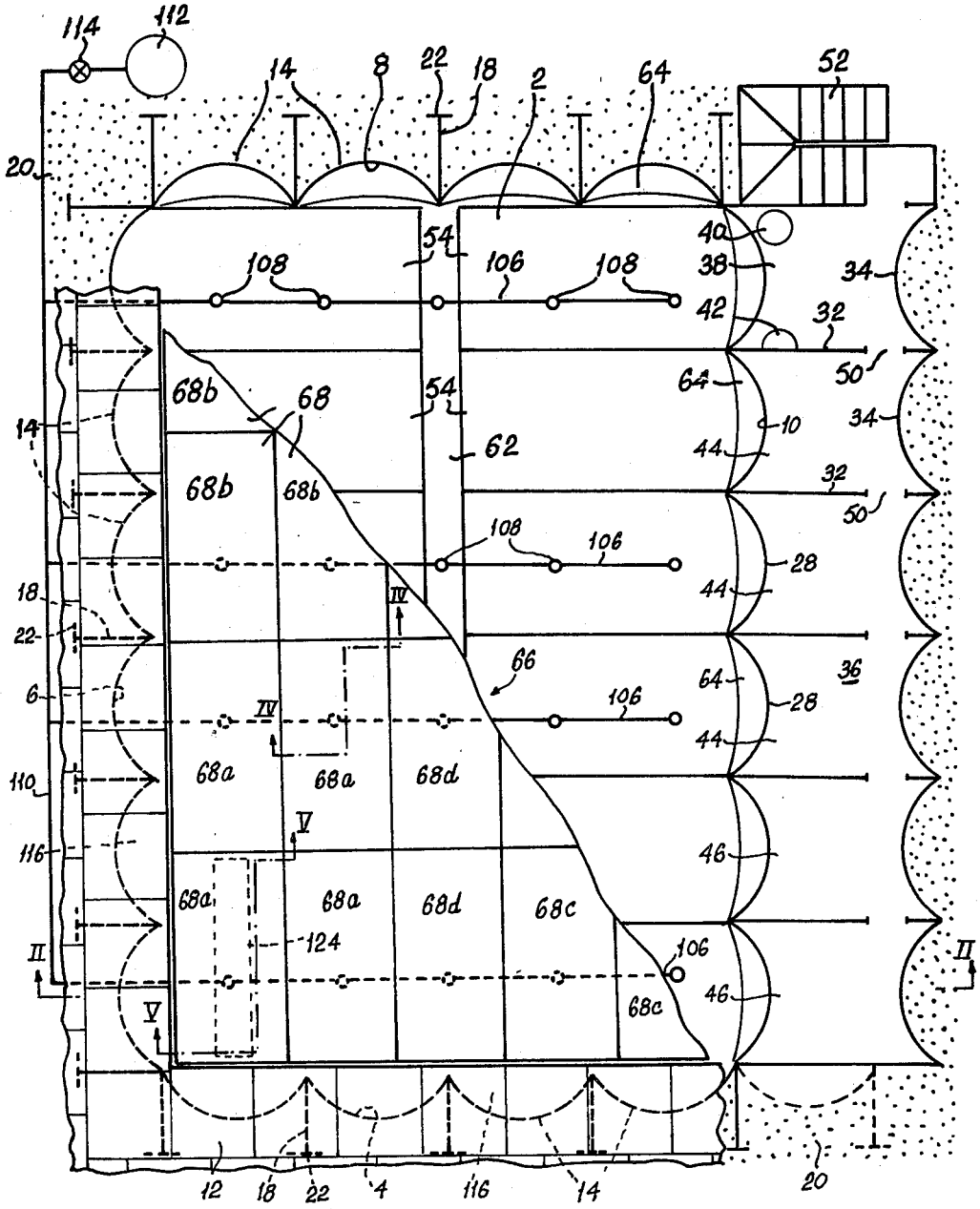

This invention relates to a liquid reservoir of the kind comprising an open-topped container having a floor and at least one side wall. Typical examples of such liquid reservoirs are swimming baths, aquaculture tanks and test tanks for research purposes.

It is well known that certain liquid reservoirs, and in particular swimming baths, when not in use for their intended purpose, have a high heat rejection rate, collect a considerable amount of debris and wind-blown rubbish, and are wasted assets unless adapted to some secondary function. Furthermore, swimming baths, whether in use or not, can be a danger and inconvenience to humans and animals who, whether by design or accident, find themselves in a depth of water unsuited to the circumstances.

The present invention aims to provide a liquid reservoir of the kind referred to with a floor which can be controlled externally of the reservoir to achieve quickly and maintain indefinitely any depth (within predetermined limits) below or even above the normal surface level of the liquid of the reservoir. Thus, in the case of a swimming bath, the invention aims to provide a floor which can be made to slope to provide beach simulation and safe bathing for children and adults, to tilt above water level to reject excess surface water, and ultimately to rise to the level of, and seal flush with, a bath-side pavement area so as to provide additional transit or recreation area rigid with the pavement area and fully sealed to prevent ingress of foreign matter and substantially to reduce the rate of heat loss from the swimming bath water. In the case of an aquaculture tank, the invention aims to provide a floor which can be raised to the level of the normal water surface when it is desired to harvest fish from the tank and to clean the tank floor.

According to the invention, a liquid reservoir of the kind referred to comprises a first floor fixed relative to said at least one side wall, and a second floor above the first floor which is able to move upwardly and downwardly relative to said at least one side wall, means for varying the specific gravity of the second floor between a first value less than and a second value greater than the specific gravity of the liquid in the reservoir, and at least one passageway between first and second spaces in the container situated respectively above and below the second floor enabling liquid to flow from one of said spaces to the other when the height of said second floor is adjusted relative to the first floor employing said specific gravity varying means.

Said second floor preferably has a specific gravity which is from 2 to 10 percent greater than that of the liquid in the reservoir. Thus, in the case of a water reservoir, such as a swimming bath, the second floor may have a specific gravity of from 1.02 to 1.10, for example about 1.05. In one embodiment of the invention, the second floor has at least one compartment which receives liquid from the container and has a specific gravity within the range just mentioned when said compartment or compartments is or are filled with liquid from the container. The means for varying the specific gravity of the second floor then conveniently comprises means for introducing a gas, for example air, into said at least one liquid-receiving compartment in order to displace liquid therefrom and so decrease the specific gravity of the second floor to a value below that of the liquid in the container. The liquid-receiving compartment or compartments may be provided with valve means, for example remotely controlled electromagnetic valves, enabling gas to be exhausted from these compartments.

The container may be of circular or oval shape in plan with a single continuous side wall extending upwardly from the first floor. However, preferably the container is of rectangular shape in plan, with four side walls extending upwardly from the first floor.

Said at least one passageway may take the form of one or more channels through the second floor in a position spaced inwardly from the perimeter of the second floor. Preferably, however, said at least one passageway is or are provided between said at least one side wall and the perimeter of said second floor. Thus, in the case of a reservoir with a second floor of rectangular shape, the four side walls of the container may be built from juxtaposed curved wall panels having their concave surfaces in contact with the liquid of the reservoir. A passageway having the cross-sectional shape of a segment of a circle then exists between each wall panel and the confronting edge surface of the second floor. Alternatively, the side walls of the container may be plane, and the edge surface or surfaces of the second floor may have re-entrant portions defining said passageways. In either case, the cross-sectional area of the passageways should be chosen so that, when the height of the second floor is varied at the maximum rate allowed by said specific gravity-varying means, there is non-turbulent flow of liquid through the passageways from one of said spaces to the other. If there is any possibility of an occupant of the reservoir, for example a fish in the case of an aquaculture tank, passing through said passageways, the latter may be partially closed with foraminous material, for example perforated sheet or mesh material.

Said second floor may be of a modular construction, comprising a plurality of identical, or substantially identical, modules fastened to one another, for example bolted together. Each module may comprise an inverted tub, for example of rectangular or hexagonal cross-section in plan, cast in a cementitious material and partly filled with foamed plastics material or lightweight concrete of zero porosity, or provided with a closed air filled chamber, so that the specific gravity of the tub is greater than the specific gravity of the liquid in the reservoir.

Figure 2:
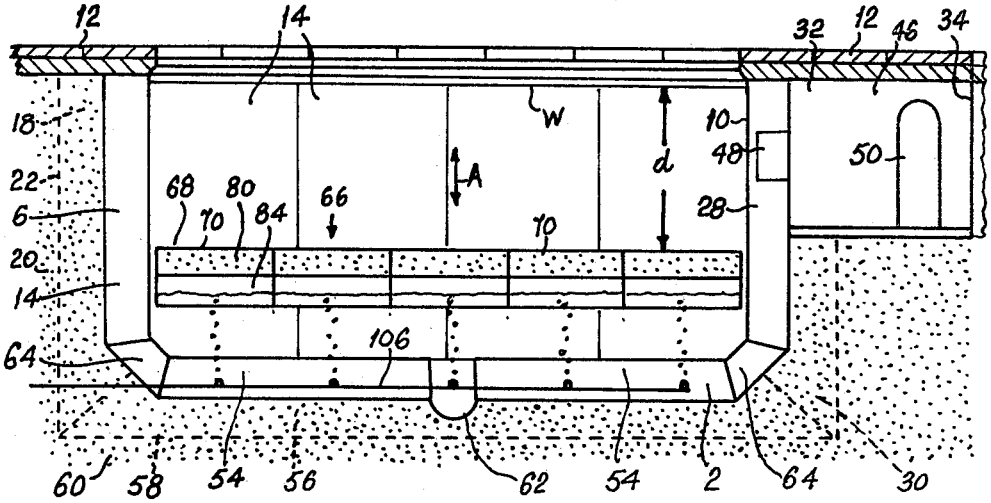
Figure 3:
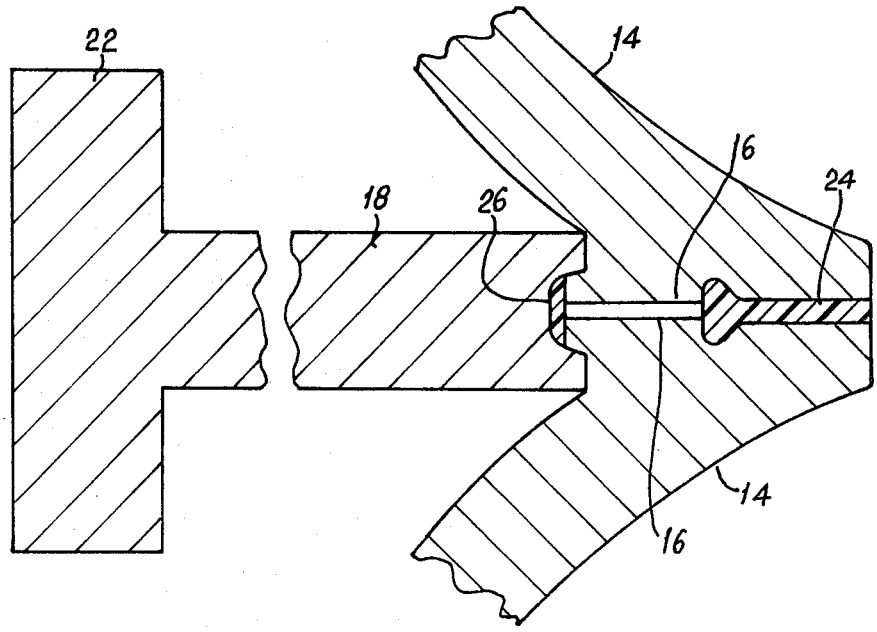

The invention will now be described, by way of example, with reference to the accompanying drawings, in which FIG. 1 is a schematic plan of one embodiment of a swimming bath in accordance with the invention, FIG. 2 is a sectional view taken on the line II—II of FIG. 1, FIG. 3 is a sectional plan, on an enlarged scale, showing part of a side wall of the swimming bath of FIGS. 1 and 2.

Figure 4:
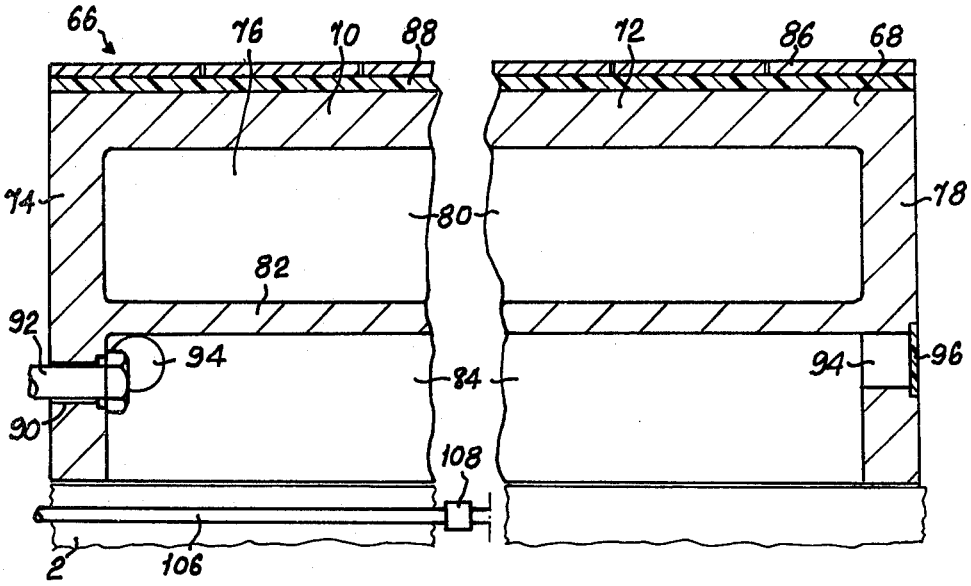
Figure 5:
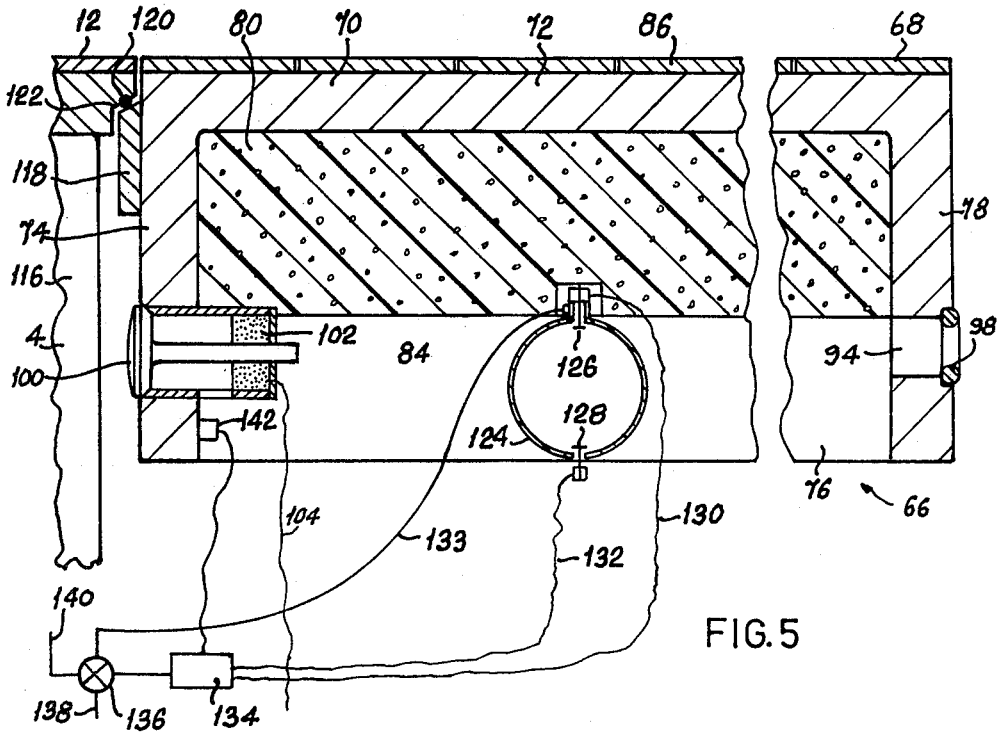

FIGS. 4 and 5 are sectional side views, on an enlarged scale, taken on the lines IV—IV and V—V, respectively, of FIG. 1, of different modules from which the second floor of the swimming bath of FIGS. 1 and 2 may be constructed, and FIGS. 6 to 9 are schematic plans of other embodiments of liquid reservoirs in accordance with the invention.

Referring to FIGS. 1 to 5, the swimming bath illustrated comprises a container wholly sunk into the ground and having a first fixed floor 2 and side walls 4, 6, 8 and 10 extending vertically upwardly from the floor 2 to a paved area 12 around the edges of the swimming bath.

Each of the side walls 4, 6 and 8 is of modular construction and comprises a plurality of panels 14 of arcuate profile, as seen from above, with their concave surfaces facing inwardly. At their juxtaposed edges 16 (see FIG. 3), adjacent panels 14 are supported by a buttress panel 18 which extends into the backfill 20 around the swimming bath and has a T-shaped end 22 anchored in this backfill. A resilient sealing strip 24 is provided between the edges 16 of adjacent panels 14 and a further resilient sealing strip 26 is provided between the buttress panel 18 and the wall panels 14 supported thereby.

Each of the panels 14 and 18 has a thickness of about 3 cm and is made of suitably reinforced cementitious material, for example the material described in British patent specification No. 1,068,163 and known under the Trade Mark "Wirand".

The side wall 10 is also of modular construction and comprises a plurality of panels 28 of arcuate profile, as seen from above, with their concave surfaces facing inwardly. At their lower ends, adjacent panels 28 are supported by buttress panels 30 anchored in the backfill 20 in the same way as the buttress panels 18. At their upper ends, adjacent panels 28 are supported by buttress panels 32 against an outer wall formed by a series of juxtaposed panels 34, also of arcuate profile as seen from above but having their convex surfaces facing inwardly. The buttress panels 32 divide the space 36 between the panels 28 and the panels 34 into a plurality of cubicles. One of these cubicles, designated with the numeral 38, may be provided with toilet facilities, such as a W.C. pan 40 and a wash basin 42, whereas the other cubicles may serve as changing rooms 44 and underwater viewing rooms 46. The underwater viewing cubicles 46 have a plate glass window 48 in the panel 28 of the cubicle. Each of the panels 32 is provided with an aperture 50 so that access can be had to all the cubicles from the foot of a flight of steps 52 leading to ground level.

The floor 2 is also of modular construction and comprises a plurality of panels 54 of arcuate profile, as seen from the side walls 6 and 10, with their concave surfaces facing upwardly. At their juxtaposed edges, adjacent panels 54 are supported by a buttress panel 56 which has a T-shaped end 58 anchored in the ground 60 below the floor 2. The panels 54, which are supported by the buttress panels 56 in exactly the same way as the panels 14 are supported by the buttress panels 18, are arranged in two groups separated by a U-shaped floor section 62 defining a channel in the floor 2 extending from the side wall 4 to the side wall 8.

Transition segments 64 of the same arcuate profile as the panels 14 and 54 fit between the floor panels and the side wall panels at 45°, these transition segments being supported by the buttress panels 18, 30 and 56.

The swimming bath has a second floor, generally designated by the numeral 66, which is movable upwardly and downwardly, as indicated by the arrows A in FIG. 2, in the container formed by the floor 2 and the walls 4, 6, 8 and 10. The floor 66 is of modular construction and comprises a plurality of modules 68 which may be constructed as shown in FIG. 4 or 5. The module 68 shown in each of these Figures is in the form of an inverted tub 70 of rectangular shape as viewed from above. The tub 70 has a closed top 72 and four depending side walls, only three of which, designated by the numerals 74, 76 and 78, respectively, can be seen in FIGS. 4 and 5. The top and the side walls may be made of suitably reinforced cementitious material, for example the aforementioned "Wirand" material.

Each tub 70 has a buoyant portion 80 which, in FIG. 4, is a closed air-filled chamber defined by the top 72, a partition wall 82 and the four side walls. In FIG. 5, the buoyant portion 80 is provided by a block of foamed plastics material, or a block of lightweight concrete, in each case with a closed pore structure, situated in the upper part of the tub adjacent to the top 72. Below the buoyant portion 80, each tub 70 has a downwardly-open compartment 84. The top 72 of each tub 70 is faced with tiles 86, and a layer 88 of thermal insulation material, for example closed cell foamed plastics material, may be disposed between the tiles 86 and the top 72, as shown in FIG. 4.

Each tub 70 is provided with a hole 90 in each of its side walls, whereby each tub can be secured to immediately adjacent tubs to form the floor 66, employing bolts 92, see FIG. 4.

Immediately below the buoyant portion 80, each side wall of each of the tubs 70 has an aperture 94 close to a corner of the tub compartment 84. Some of these apertures 94 may be closed by a diaphragm 96, as shown in FIG. 4, or may receive an O-ring 98, as shown in FIG. 5. Depending on whether the diaphragms 96 or the O-rings 98 are provided in the apertures 94, the compartments 84 of adjacent tubs 70 can be sealed from one another or be made to communicate with one another when the tubs are bolted together to form the floor 66. Preferably, the diaphragms 96 and the O-rings 98 are provided in the apertures 94 in such a way that the floor 66 is divided into five zones each comprising a plurality of the tubs 70 with their compartments 84 communicating with one another, but with the interconnected compartments 84 of one zone sealed from the interconnected compartments 84 of all the other zones. Thus, referring to FIG. 1, a first zone of the floor 66 is provided by the four modules 68*a* at one corner of the floor, a second zone is provided by four modules 68*b* at a second corner of the floor, a third zone is provided by four modules 68*c* at a third corner of the floor, a fourth zone is provided by another group of four modules (not shown) at a fourth corner of the floor, and a fifth zone is provided by a row of four modules 68*d* disposed between the modules at the first and second corners of the floor, on the one hand, and the modules at the third and fourth corners of the floor, on the other hand.

In each of these five zones of the floor 66, one of the tubs 70 which defines part of the perimeter of the floor 66, is provided with an electromagnetically-actuated valve 100 (see FIG. 5) in one of its outwardly-facing walls. Normally the valve 100 is open so that water in the swimming bath can enter all the interconnected compartments 84 of the tubs 70 of the zone. Energisation of the coil 102 of the valve 100, via a lead 104 connected to a suitable voltage source (not shown) externally of the swimming bath, causes the valve 100 to close (i.e. to the position shown in FIG. 5).

With the valves 100 of each of the five zones of the floor 66 in open position, all the compartments 84 of the floor become filled with water from the swimming bath. In this condition of the floor 66, it has a specific gravity of about 1.05 and consequently sinks down in the swimming bath onto the fixed floor 2 (which is the condition of the module 68 shown in FIG. 4). Laid across the floor 2 are four pipes 106 each having five outlet nozzles 108 situated under respective compartments 84 of the floor 66. The pipes 106 are connected to a common compressed air line 110 leading to a compressed air reservoir 112 via a control valve 114 (see FIG. 1).

By closing all the valves 100 and opening the air control valve 114, compressed air can be introduced into all the compartments 84 of the floor 66 simultaneously to displace water therefrom. This has the effect of reducing the specific gravity of the floor 66 to a value less than unity, with the result that the entire floor rises in the swimming bath until the tiles 86 of the modules 68 lie flush with the paved area 12 of the swimming bath. In FIG. 2 the floor 66 is shown in the position after it has risen part of the way towards its uppermost position, whereas FIG. 5 shows the floor module 68 in its uppermost position in the swimming bath. As the floor 66 rises from its lowermost position on the fixed floor 2 in this way, water above the floor 66 flows down through passageways 116, disposed between the perimeter of the floor 66 and the arcuate panels 14 and 28, to the space between the floors 2 and 66.

In the uppermost position of the floor 66 (see FIG. 5), a strip 118 secured around the perimeter of the floor 66 seats against a resilient seal 120 provided on an undersurface 122 of the paved area 12 which overhangs the side walls 4, 6, 8 and 10.

The rate at which the floor 66 rises from its lowermost position to its uppermost position is determined by the rate at which compressed air is delivered to the compartments 84 from the reservoir 112. If it is simply a matter of closing the open top of the swimming bath in order to reduce heat loss from the water and to prevent debris entering the bath, the floor 66 can be raised slowly (for example through a height of 3 m in about 5 minutes) by only partly opening the air control valve 114. If, on the other hand, someone is in difficulty in the swimming bath and in danger of drowning, opening of the valve 114 to its full extent will result in the floor 66 rising much more rapidly (for example through a height of 3 m in as little as 15 seconds).

In order to provide adjustment of the height and/or slope of the floor 66 in use of the swimming bath, at least one module 68 at each of the four corners of the floor is provided with a trimming tank 124 (see FIG. 5). The tank 124 has two electromagnetically controlled valves 126 and 128 connected by leads 130 and 132, respectively, to a control unit 134 which is energised from the aforementioned voltage source. The control unit 134 may be situated at any convenient location outside the swimming bath, for example on the paved area 12.

The valve 126 is connected via a flexible pipe 133 to a three-way valve 136. The latter is driven electrically from the control unit 134 and controls connection of the pipe 133 either to exhaust via a pipe 138 or to a pipe 140 connected to the compressed air reservoir 112 (FIG. 1). The valve 128 controls the flow of water into and out of the tank 124.

A water pressure sensor 142 is secured to the module 68 inside the compartment 84 and supplies an electric signal to the control unit 134 the magnitude of which is proportional to the depth of immersion of the tiled upper surface of the module 68 below the water level W (see FIG. 2) of the water in the swimming bath.

Reference signals proportional to the desired depth of immersion of the tiled upper surface of each corner of the floor 66 can be set in the control unit 134. These reference signals are compared in the control unit 134 with the actual depth of immersion signals provided by the sensors 142 at the four corners of the floor 66.

Let it be assumed that at each corner of the floor 66 the valve 128 is open, that the valve 126 is closed, and that the tank 124 and the compartment 84 are full of water, i.e. that the floor 66 has its maximum specific gravity and rests on the floor 2. If it is then desired to raise the floor 66 to an intermediate position in the swimming bath, for example so that it has the depth of immersion d shown in FIG. 2, reference signals corresponding to this depth of immersion are set in the control unit 134. The control unit senses that the depth of immersion of the floor 66 is greater than the desired length of immersion and opens the valve 126 and sets the valve 136 to connect the pipe 133 to the compressed air reservor 112 via the pipe 140. As a result water is displaced from the tanks 124 via the open valves 128 to reduce the specific gravity of the floor 66. The floor 66 then rises until the depth of immersion signals supplied to the control unit by the sensors 142 correspond to the reference signals set in the control unit 134. When this is achieved, the control unit 134 closes the valves 126 and 128 and the floor 66 comes to rest at the desired depth of immersion. If the floor 66 has a tendency to sink from this desired position, the control unit 134 again opens the valves 126 and 128 to displace more water from the tanks 124. If, on the other hand, the floor 66 tends to rise above its desired position, the control unit 134 adjusts the valve 136 to connect the pipe 133 to exhaust via the pipe 138 and re-opens the valves 126 and 128. Water from the swimming bath can then flow into the tanks 124 to increase the specific gravity of the floor 66 and return it to the desired depth of immersion. In this way the control unit 134 continuously monitors the depth of immersion of the floor 66 and maintains the depth of immersion at the desired value.

By setting different depth of immersion reference signals in the control unit 134 for one end of the floor 66 compared with the other end, it will be appreciated that it is possible to make the floor 66 slope from one end of the swimming bath to the other.

Figure 6:
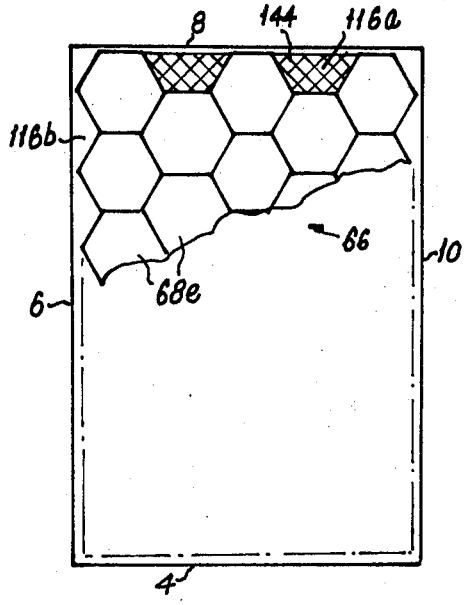

The invention is not, of course, limited to the particular embodiment described in detail above with reference to FIGS. 1 to 5. Thus, for example, FIGS. 6 to 9 show schematically various ways in which the floor 66 may be arranged in a container having plane side walls 4, 6, 8 and 10. In FIG. 6, the floor 66 is made up from hexagonal modules 68*e* resulting in the formation of passageways 116*a* of trapezoidal shape and passageways 116*b* of triangular shape between the perimeter of the floor 66 and the side walls of the container. Some or all of these passageways may be covered with foraminous sheets screens or mesh material 144 to prevent persons (in the case of a swimming bath) or fish (in the case of an aquaculture tank) from entering the passageways.

Figure 7:
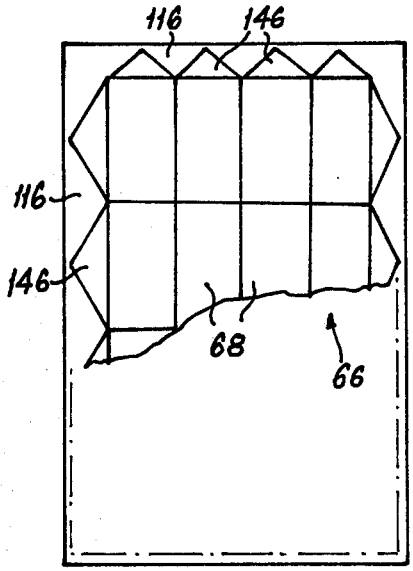

In FIG. 7, the floor 66 is constructed from rectangular modules 68, as in the embodiment of FIGS. 1 to 5, and the passageways 116 are formed by attaching blocks 146 of triangular cross-section around the perimeter of the floor. The blocks 146 may be made of a closed pore foamed material.

Figure 8:
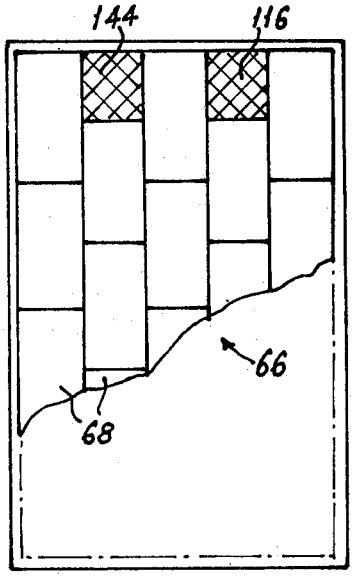
Figure 9:
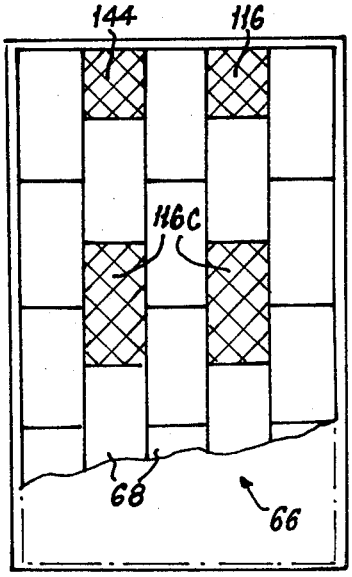

FIGS. 8 and 9 show other embodiments of floors 66 made up from rectangular modules 68. In FIG. 8, passageways 116 are provided adjacent the side walls 4 and 8. This is also the case in FIG. 9, but in addition further passageways 116*c* are provided inside the perimeter of the floor 66. Screen or mesh materials 144 are provided in these passageways as shown in FIG. 6.

Although in the embodiment of the invention described in detail above with reference to FIGS. 1 to 5, the container is wholly sunk into the ground and is made of cementitious material, the invention is not, of course, limited to these features. For example the container may be only partly sunk into the ground or it may be entirely above ground. Furthermore, the container and the floor 66 may be made of various other materials, for example plastics material or sheet metal.

What is claimed is:

1. A liquid reservoir comprising an open-topped container having at least one side wall, a first floor fixed relative to said at least one side wall and a second floor above the first floor which is able to move upwardly and downwardly relative to said at least one side wall, said wall and floors being of a rigid material which is water impermeable, said second floor comprising a plurality of downwardly-open compartments, means for varying the specific gravity of the second floor between a first value less than and a second value greater than the specific gravity of the liquid in the reservoir, said specific gravity-varying means comprising means for supplying gas under pressure into said downwardly-open compartments, at least one trimming tank mounted on in one of said downwardly-open compartments of the second floor and means for introducing liquid from the reservoir into said at least one trimming tank and for displacing liquid from said at least one trimming tank to control the inclination of said second floor, and at least one passageway between first and second spaces in the container situated repectively above and below the second floor enabling liquid to flow from one end of said spaces to the other when the height of said second floor is adjusted relative to the first floor employing said specific gravity-varying means.

2. A liquid reservoir according to claim 1, in which said second floor has a maximum specific gravity which is from 2 to 10 percent greater than that of the liquid in the reservoir.

3. A liquid reservoir according to claim 1, in which at least one of said compartments comprises remotely-actuable valve means for releasing gas therefrom.

4. A liquid reservoir according to claim 1, in which said at least one passageway comprises at least one channel through the second floor in a position spaced inwardly from the perimeter of the second floor.

5. A liquid reservoir according to claim 1, in which said at least one passageway comprises at least one channel between said at least one side wall and the perimeter of the second floor.

6. A liquid reservoir according to claim 5, in which said at least one side wall is constructed from a series of side-by-side panels of arcuate profile with their concave surfaces facing inwardly, and said second floor has an edge surface which defines, with said arcuate panels, a series of channels of segmental cross-section forming said passageways.

7. A liquid reservoir according to claim 1, in which said at least one passageway is provided with a foraminous screen.

8. A liquid reservoir according to claim 1, in which said second floor is of modular construction and comprises a plurality of substantially identical modules secured to one another.

9. A liquid reservoir according to claim 8, in which each of said modules is of rectangular shape in plan.

10. A liquid reservoir according to claim 8, in which each of said modules is of hexagonal shape in plan.

11. A liquid-reservoir according to claim 8, in which each of said modules is in the form of an inverted tub providing one of said downwardly-open compartments, each tub comprising a buoyant portion adjacent the closed top of the tub.

12. A liquid reservoir according to claim 11, in which said buoyant portion is formed by a block of closed cell foamed material.

13. A liquid reservoir according to claim 11, in which said buoyant portion is formed by an hermetically sealed chamber.

14. A liquid reservoir according to claim 1 and comprising a second floor of substantially rectangular shape in plan, in which one of said trimming tanks is disposed adjacent to each corner of the second floor.

15. A liquid reservoir according to claim 14, comprising means for automatically controlling the quantity of liquid in each trimming tank to maintain the second floor at a desired depth of immersion and/or a desired inclination to the horizontal in the container.

* * * * *

UNITED STATES PATENT AND TRADEMARK OFFICE

CERTIFICATE OF CORRECTION

PATENT NO. : 4,364,131

DATED : December 21, 1982

INVENTOR(S) : Robert Cecil Clerk

It is certified that error appears in the above-identified patent and that said Letters Patent is hereby corrected as shown below:

Column 6, line 17, "reservor" should read --reservoir--;
Claim 1, line 33, delete "on";
line 43, delete "end".

Signed and Sealed this

*Eighth* Day of *March 1983*

[SEAL]

*Attest:*

GERALD J. MOSSINGHOFF

*Attesting Officer*

*Commissioner of Patents and Trademarks*